United States Patent [19]

Baba

[11] Patent Number: 4,804,080

[45] Date of Patent: Feb. 14, 1989

[54] WORK INDEXING MECHANISM WITH A HEIGHT ADJUSTMENT FOR A PAIR OF TRANSFER BARS

[75] Inventor: Kiyokazu Baba, Komatsu, Japan

[73] Assignee: Kabushiki Kaisha Komatsu Seisakusho, Tokyo, Japan

[21] Appl. No.: 731,620

[22] Filed: May 6, 1985

Related U.S. Application Data

[63] Continuation of Ser. No. 415,820, Sep. 8, 1982, abandoned.

[51] Int. Cl.[4] ..... B65G 25/04

[52] U.S. Cl. ..... 198/621; 74/829

[58] Field of Search ..... 414/751, 750; 198/621; 74/586, 583, 828, 829, 831

[56] References Cited

U.S. PATENT DOCUMENTS

| | | | |
|---|---|---|---|
| 2,640,425 | 6/1953 | Saalfrank | 74/828 |
| 2,929,253 | 3/1960 | Baldelli | 74/586 X |
| 3,456,814 | 7/1969 | Bautz | 414/751 X |
| 3,655,070 | 4/1972 | Haydu | 198/621 X |
| 4,177,681 | 12/1979 | Wess | 74/586 X |

FOREIGN PATENT DOCUMENTS

| | | | |
|---|---|---|---|
| 108074 | 8/1979 | Japan | 198/621 |

*Primary Examiner*—Joseph E. Valenza
*Assistant Examiner*—Stuart J. Millman
*Attorney, Agent, or Firm*—Armstrong, Nikaido, Marmelstein & Kubovcik

[57] ABSTRACT

An indexing mechanism for a three-dimensional transfer press system wherein a pair of parallel spaced transfer bars are moved back and forth, up and down, and toward and away from each other for transporting successive panels through a series of press stations. A height adjustment for the transfer bars are connected between a lift cam mechanism and a rack-and-pinion linkage, the latter linking the former to two pairs of lift carriers carrying the transfer bars so as to allow their longitudinal reciprocation and movement toward and away from each other. Comprising either a multiple abutment member, a screw-and-nut assembly, or a double-acting hydraulic cylinder, the height adjustment provdes a variable length of connection between the lift cam mechanism and the rack-and-pinion linkage for adjustably varying the upper and lower limits between which the transfer bars are moved up and down.

4 Claims, 5 Drawing Sheets

WORK INDEXING MECHANISM WITH A HEIGHT ADJUSTMENT FOR A PAIR OF TRANSFER BARS

This application is a continuation of application Ser. No. 415,820, filed Sept. 8, 1982, now abandoned.

BACKGROUND OF THE INVENTION

This invention relates to a mechanism for indexing or feeding work through a succession of processing stations, and in particular to such a mechanism in a three-dimensional transfer press system for the fabrication of various panel products such as those used for roofing, flooring, and doors. More particularly, the invention concerns means in such an indexing mechanism for adjustably varying the vertical positions of a pair of transfer bars.

As is well known, in a three-dimensional transfer press system, the pair of transfer bars in question, extending horizontally in parallel spaced relation to each other, are reciprocated longitudinally and further moved up and down and toward and away from each other. By the repetition of these motions in a prescribed sequence the transfer bars transport successive panels from one press station to another. The press system allows changes of dies for the fabrication of various panel products. Thus, as the lower dies of varying heights are used, corresponding changes must be made in the normal vertical positions of the transfer bars.

SUMMARY OF THE INVENTION

The present invention seeks to make it possible, in a work indexing mechanism of the type defined, to adjustably vary the upper and lwoer limits between which the transfer bars are moved up and down, by making utmost use of the parts existing in such a mechanism.

Stated in brief, the invention specifically concerns a mechanism for imparting up-and-down motion to the pair of transfer bars. Included are lift carrier means carrying the transfer bars so as to allow their longitudinal reciprocation and movement toward and away from each other. A lift cam mechanism is coupled to the lift carrier means via a rack-and-pinion linkage for moving the transfer bars up and down. A height adjustment is interposed between the lift cam mechanism and the rack-and-pinion linkage to provide a variable length of connection therebetween and hence to adjustably vary the upper and lower limits between which the transfer bars are moved up and down.

The above and other objects, features and advantages of this invention and the manner of attaining them will become more apparent, and the invention itself will best be understood, from a study of the following description of some preferable embodiments taken together with the attached drawings.

DESCRIPTION OF THE PREFERRED EMBODIMENTS

Figure 1:
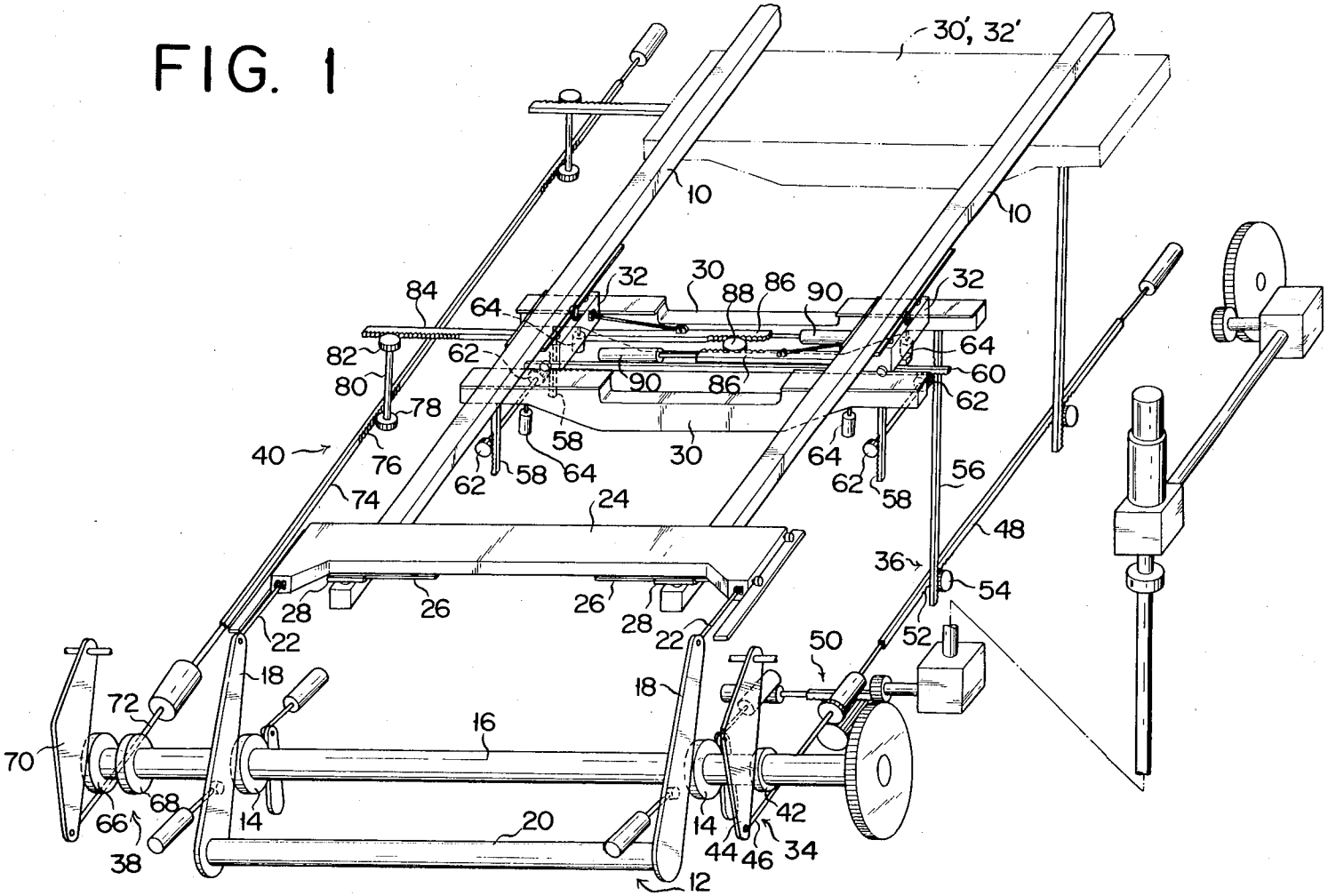
FIG. 1 illustrates in perspective the complete mechanism for conveying work through a series of processing stations in a three-dimensional transfer press system.

A consideration of FIG. 1 will make clear the general organization of the work indexing mechanism for a three-dimensional transfer press system to which the inventive concepts find application. The reference numeral 10 in this figure denotes a pair of transfer bars extending horizontally and in parallel spaced relation to each other. At the opposite extremities of the transfer bar pair there are provided a pair of feed mechanisms 12, one shown, which cooperate to reciprocate the transfer bars longitudinally. The two feed mechanisms are essentially identical in construction, so that only the illustrated one will be described in detail, it being understood that the same description applies to the other.

The representative feed mechanism 12 comprises a pair of disc cams 14 mounted on a camshaft 16 for simultaneous rotation therewith. Held against the respective disc cams are a pair of cam follower levers 18 capable of oscillation about a common pivot 20. The free ends of these cam follower levers are pivotally jointed via respective links 22 to a feed carrier 24 having on its underside a pair of guides 26 extending transversely of the transfer bars 10. A shoe 28 on each transfer bar grips one of the guides 26 for sliding motion therealong. It is thus seen that the feed mechanism 12 is cam operated to cause joint longitudinal reciprocation of the transfer bars 10 while still allowing them to move up and down and toward and away from each other.

For such vertical and sideways movements the transfer bars 10 are supported on two pairs of lift carriers 30 and two pairs of grip carriers 32. The two pairs of lift carriers, and the two pairs of grip carriers, are both identical in construction, so that FIG. 1 illustrates in detail only one pair of lift carriers and one pair of grip carriers together with means associated therewith. The other pairs of lift carriers and grip carriers are merely depicted by the phantom outline generally referenced 30', 32'.

Th representative pair of lift carriers 30 extend transversely of the transfer bars 10 in parallel spaced relation to each other. Extending between the lift carriers are the representative pair of grip carriers 32 each supported at its opposite ends on the lift carriers for rolling motion thereon. The pair of transfer bars 10 are supported one on each grip carrier 32 for longitudinal displacement while being constrained to joint lateral motion therewith. The pair of lift carriers 30 are moved up and down by a lift cam mechanism 34 via a rack-and-pinion linkage 36. The pair of grip carriers 32, on the other hand, are moved toward and away from each other by a grip cam mechanism 38 via a rack-and-pinion linkage 40. A detailed description of these cam mechanisms 34 and 38 and drive linkage 36 and 40 follows.

The lift cam mechanism 34 comprises a disc cam 42 fixedly mounted on the camshaft 16, and a cam follower lever 44 held against the contoured edge of the cam thereby to be oscillated about a fixed pivot. The cam follower lever 44 has its free end pivotally coupled to a link 46. Interposed between this link and a rack 48 forming a part of the rack-and-pinion linkage 36 is a height adjustment 50 for the pair of transfer bars 10. The height adjustment will be detailed after the description, in progress, of the complete work indexing mechanism of FIG. 1.

Extending under and parallel to one of the transfer bars 10, the rack 48 of the rack-and-pinion linkage 36 is toothed at 52 to mesh with a pinion 54. Also in mesh with this pinion is another rack 56 extending upwardly therefrom and secured to one of the lift carriers 30. It will be seen that the rack-and-pinion linkage 36 additionally comprises three other upstanding racks 58, a horizontal rack 60, and four pinions 62, which are interrelated as shown to cause up-and-down motion of the representative pair of lift carriers 30 in coaction with the noted rack 56. A pair of air cylinders 64 yieldably urge each lift carrier 30 upwardly.

The grip cam mechanism 38 comprises a three-dimensional grip cam 66 and two-dimensional grip cam 68 which are both non-rotatably mounted on the camshaft 16 for axial displacement, and a cam follower lever 70 held against the contoured edge of either of the cams 66 and 68 thereby to be oscillated about a fixed pivot. The free end of the cam follower lever 70 is pivotally coupled to a link 72, which in turn is rigidly coupled to a rack 74 of the rack-and-pinion linkage 40 in end-to-end relation. The rack 74 is toothed at 76 to mesh with a pinion 78 fixedly mounted on one end of an upstanding rotatable shaft 80. Mounted on the other end of this shaft, for simultaneous rotation with the pinion 78, is another pinion 82 in mesh with a rack 84 rigidly anchored to the left hand one, as seen in FIG. 1, of the grip carriers 32.

The pair of grip carriers 32 are interlocked by two racks 86 extending one from each grip carrier toward the other and both gearing with a pinion 88 located midway therebetween. Thus the travel of the left hand grip carrier toward or away from the right hand one, caused by the grip cam mechanism 38 via the rack-and-pinion linkage 40, results in the simultaneous travel of the right hand grip carrier in the opposite direction. A pair of air cylinders 90 yieldable urge the grip carriers toward each other.

As is seen from the foregoing, the pair of transfer bars 10 are moved back and forth, up and down, and toward and away from each other by the noted cam mechanisms. The repetition of these motions in a prescribed sequence enables the transfer bars to grip, lift, and transport successive panels from one press station to the next.

Figure 2:
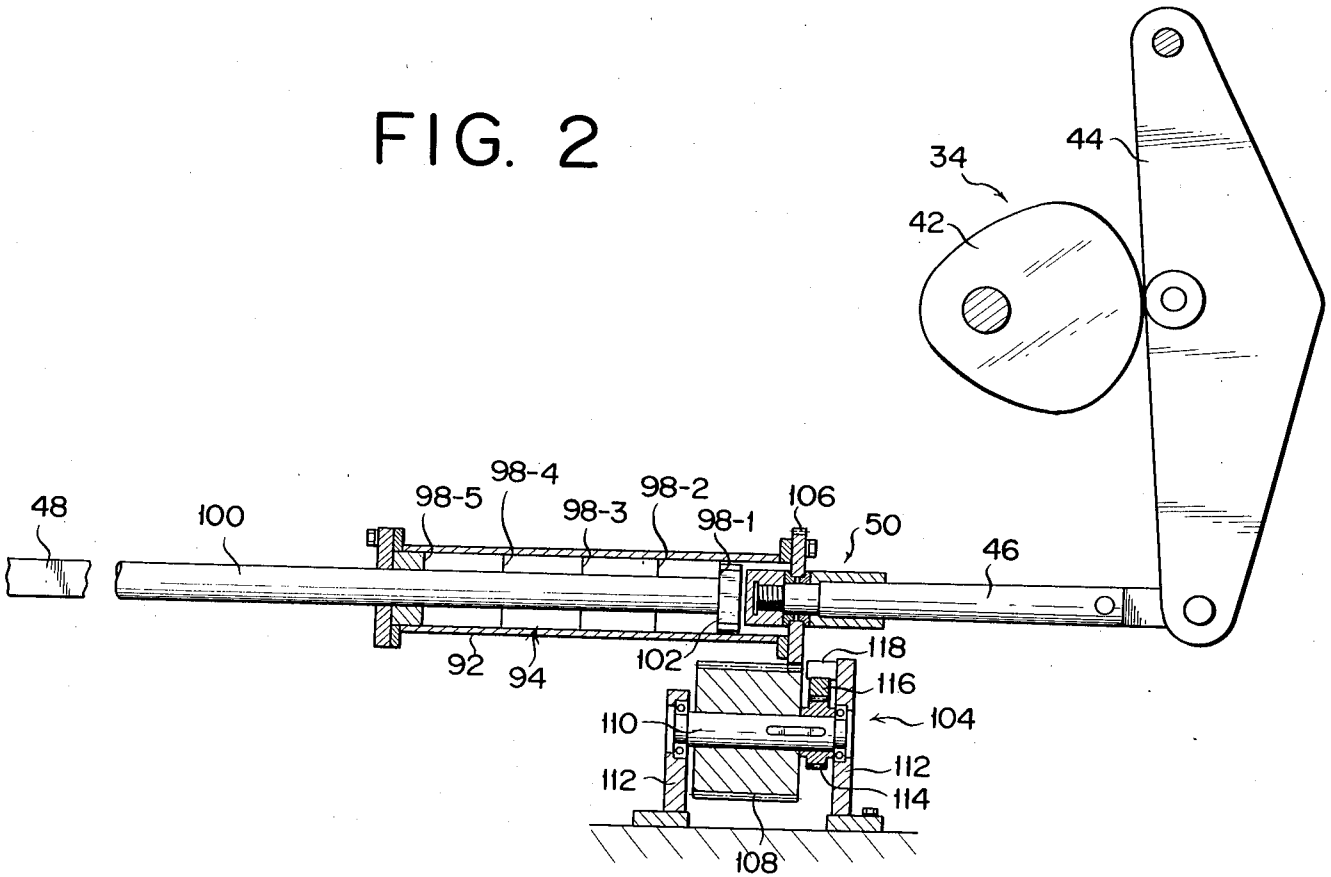
FIG. 2 is an enlarged side elevation, partly drawn in section for clarity, of the essential parts of the mechanism of FIG. 1 including a preferable form of the height adjustment for the transfer bars in accordance with the invention.
Figure 3:
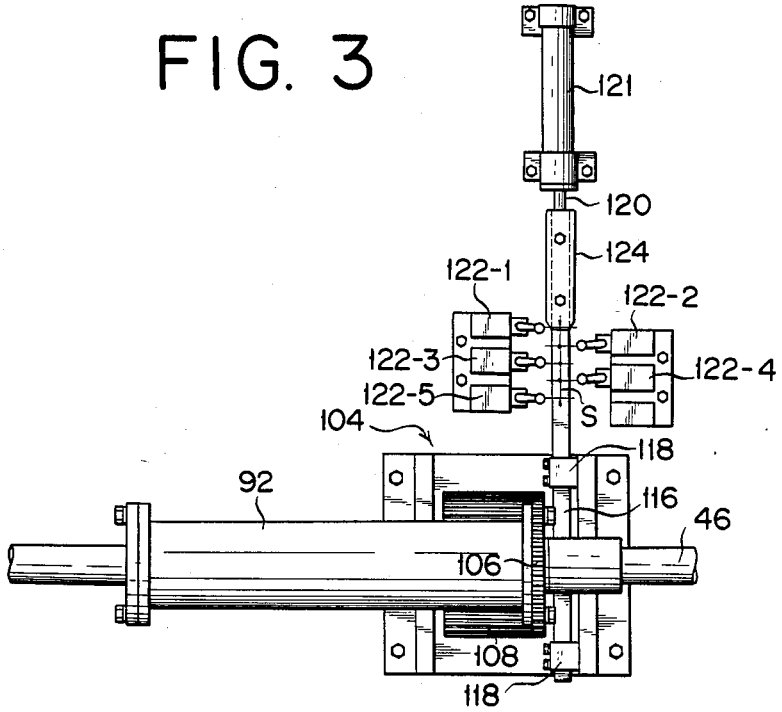
FIG. 3 is a plan of the height adjustment of FIG. 2.
Figure 4:
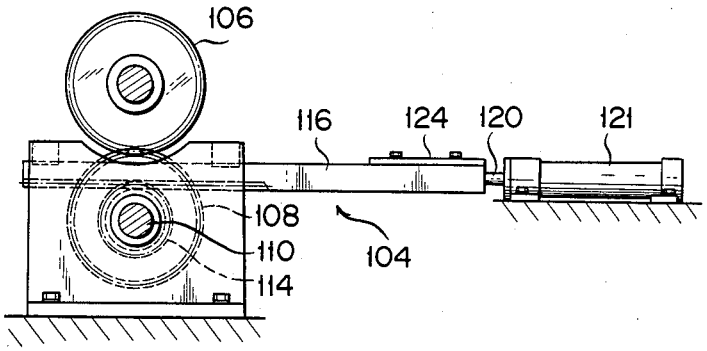
FIG. 4 is the right hand side elevation of the height adjustment of FIG. 2.

FIGS. 2, 3 and 4 are detailed representations, on an enlarged scale, of the aforesaid height adjustment 50 intended to provide a variable length of connection between the lift cam mechanism 34 and the rack-and-pinion linkage 36. As best seen in FIG. 2, the height adjustment 50 includes a tubular abutment housing 92 arranged end to end and co-linearly with the noted link 46. One end of the abutment housing 92 is rotatably engaged with the opposed end of the link 46 while being locked against longitudinal displacement relative to the link. The abutment housing 92 immovably encloses a multiple abutment member 94.

Figure 5:
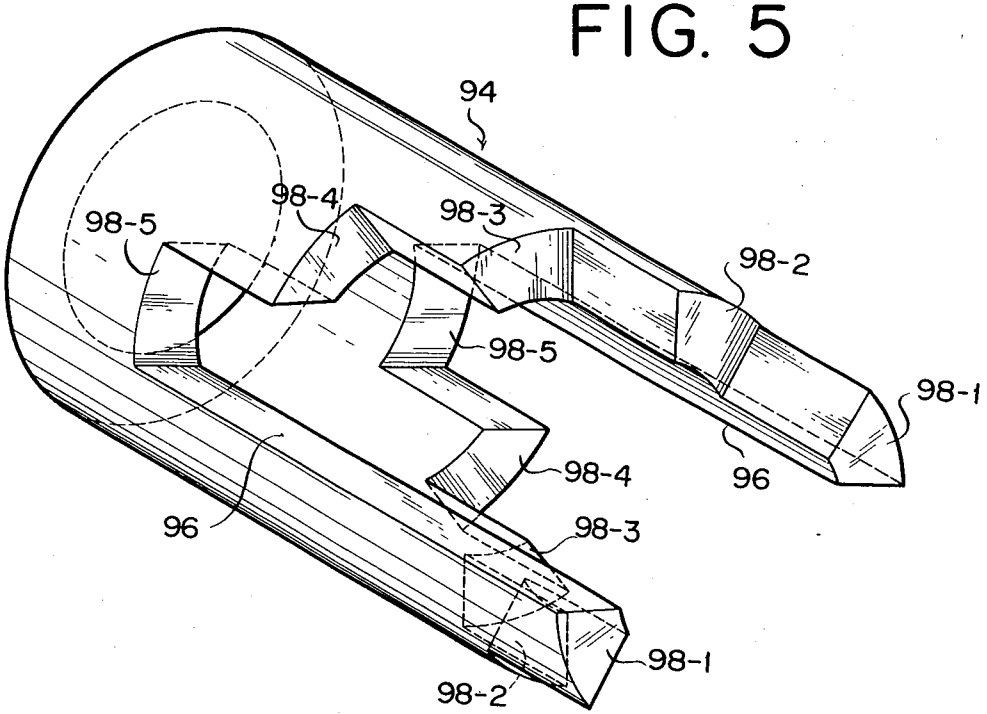
FIG. 5 shows in perspective and on an enlarged scale the multiple abutment member in the height adjustment of FIGS. 2, 3 and 4.

As better pictured in FIG. 5 on a greatly enlarged scale, the multiple abutment member 94 is generally in the shape of a hollow cylinder. This cylinder is recessed at 96 in two diametrically opposed positions, with the recesses extending from one end of the cylinder toward the other. The recesses 96 are stepped to provide a total of five diametrically opposed pairs of abutments 98-1, 98-2, 98-3, 98-4 and 98-5 in successive circumferential positions and at constant axial spacings. All these abutments are oriented toward the lift cam mechanism 34.

With reference back to FIG. 2 in particular, a rod-like link 100 slidably extends through the multiple abutment member 94 for both relative rotation and longitudinal displacement. Projecting out of the left hand end of the abutment housing 92, the link 100 is rigidly and collinearly coupled to the rack 48 of the rack-and-pinion linkage 36 and is thereby restrained from rotation. On the right hand end of this link, on the other hand, there is formed a hook 102 capable of simultaneously engaging any one pair of abutments of the multiple abutment member 94. Preferably, the hook 102 has a width less than the circumferential dimension of any one abutment of the multiple abutment member.

It will be recalled upon inspection of FIG. 1 that the air cylinders 64 bias the pair of lift cariers 30 upwardly. The upward bias thus exerted on the lift carriers results in a leftward pull, as viewed in FIG. 2, on the link 100, so that the hook 102 on its right hand end is urged against one of the pair of abutments 98-1 to 98-5 depending upon the angular position of the multiple abutment member 94, and therefore of the abutment housing 92, relative to the link 100.

The reference numeral 104 in FIGS. 2, 3 and 4 generally designates drive means for revolving the abutment housing 92 to bring the multiple abutment member 94 to a desired angular position with respect to the link 100. The drive means 104 include a driven spur gear 106 coaxially mounted to the abutment housing 92 for joint rotation therewith. The driven gear 106 meshes with a driving spur gear 108 fixedly mounted on a spindle 110 having its opposite ends rotatably journaled in a pair of opposed lugs 112. The drive gear 108 has a sufficient axial dimension to remain in mesh with the driven gear 106 in spite of the back-and-forth motion of the latter. Also firmly mounted on the spindle 110 is a pinion 114 in gear with a rack 116 slidable along a pair of guides 118 on one of the lugs 112. The rack 116 is couple to the piston rod 120 of a fluid actuated cylinder 121, preferably hydraulic.

Seen at 122-1, 122-2, 122-3, 122-4 and 122-5 in FIG. 3 are five limit switches lying on both sides of the rack 116 in staggered arrangement. A switch actuator 124 fastened to the rack 116 can activate these limit switches one after the other during its forward travel over a distance S, which is equal to the piston stroke of the hydraulic cylinder 121. The locations of the limit switches 122-1, to 122-5 correspond to the angular positions of the abutment pairs 98-1 to 98-5, respectively, of the multiple abutment member 94 relative to the hook 102.

In the operation of the work indexing mechanism, particularly in regard to the height adjustment 50, let it be first assumed that the hook 102 on the link 100 is now held against the pair of abutments 98-1 at the extreme right of the multiple abutment member 94, as in FIG. 2, by the forces of the air cylinders 64 acting on the pair of lift carriers 30. As the cam follower lever 44 of the lift cam mechanism 34 rides over the lobe of the disc cam 42, it exerts a rightward pull on the rack 48 of the rack-and-pinion linkage 36 via the link 46, abutment housing 92, multiple abutment member 94, hook 102, and link 100. The result is the descent of the lift carriers 30 against the forces of the air cylinders 64. Subsequently riding off the lobe of the disc cam 42, the cam follower lever 44 allows the lift carriers 30 to ascent by the forces of the air cylinders 64.

For changing the upper and lower limits between which the pair of transfer bars 10 are moved up and down as above, the air cylinders 64 may be vented to release the link 100 from the leftward pull as seen in FIG. 2. Then the hydraulic cylinder 121 of FIGS. 3 and 4 may be activated by cause revolution of the abutment housing 92, together with the multiple abutment member 94 received therein, relative to the link 100 until a desired one of the abutment pairs 98-1 to 98-5 comes opposite to the hook 102 on the link 100. The hydraulic cylinder 121 can be automatically set out of motion as the switch actuator 124 engages that one of the limit switches 122-1 to 122-5 which corresponds to the desired pair of abutments.

Then the air cylinders 64 may be re-pressurized to bias the lift carriers 30 upwardly. Upon consequent exertion of a leftward pull on the link 100 the hook 102 on its end will move into contact with the desired pair of abutments of the multiple abutment member 94. Thus, with the operation of the lift cam mechanism 34, the pair of transfer bars 10 will move up and down between a different set of upper and lower limits.

It will be appreciated that the height adjustment 50 with the multiple abutment member 94 provides a set of definite lengths of connection between lift cam mechanism 34 and rack-and-pinion linkage 36, making it possible to positively maintain any selected length of connection therebetween. Further the height adjustment can be set at any of the several lengths of connection within up to 180 degrees of revolution of the multiple abutment member 94, requiring a minimal length of time even for a change between the shortest and the longest.

Figure 6:
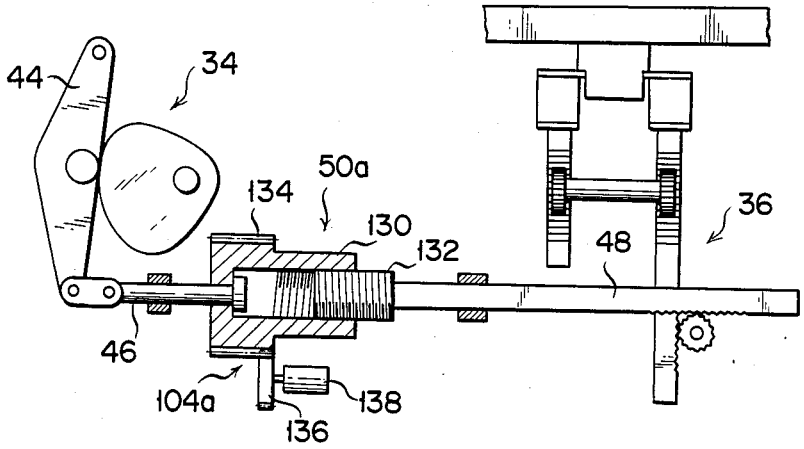
FIG. 6 is a schematic side elevation, partly shown in section for clarity, of another preferable form of the height adjustment together with associated parts of the work indexing mechanism.

FIG. 6 shows an alternative form of the height adjustment. Generally referenced 50*a*, the alternative height adjustment includes a nut 130 rotatably engaged with the link 46 which is operatively coupled as aforesaid to the cam follower lever 44 of the lift cam mechanism 34. The nut 130 generally extends away from the link 46 in co-linear relation and is constrained to joint longitudinal reciprocation therewith. Engaged in the nut 130 is an externally screw-threaded portion 132 at one end of the rack 48 forming a part of the rack-and-pinion linkage 36.

It is evident, then, that the length of connection between lift cam mechanism 34 and rack-and-pinion linkage 36 is infinitely or continuously variable by revolving the nut 130 relative to the threaded portion 132 of the rack 48. Particular drive means 104*a* adopted to that end in this embodiment include a set of spur gear teeth 134 formed on the nut 130, a spur pinion 136 in mesh with the gear teeth 134, and a motor drive unit 138 coupled directly to the pinion 136. The bidirectional rotation of the motor drive unit results in the extension and contraction of the length of connection between lift cam mechanism 34 and rack-and-pinion linkage 36.

Figure 7:
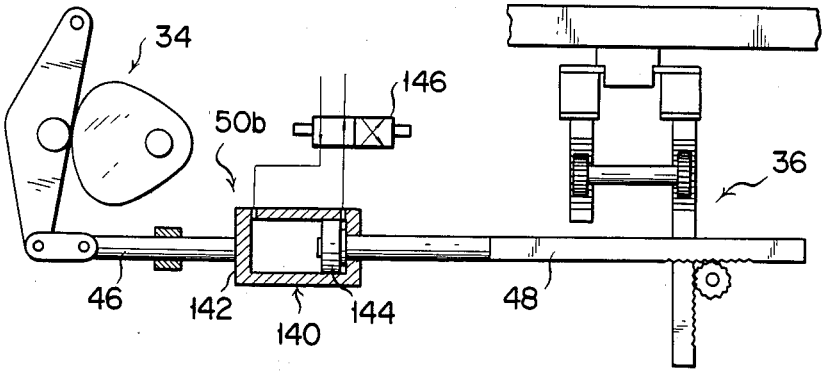
FIG. 7 is a view similar to FIG. 6 but showing still another preferable form of the height adjustment.

In FIG. 7 is given still another preferable form of height adjustment 50*b*. It comprises a double-acting hydraulic cylinder 140 having, in this particular embodiment, a body 142 rigidly connected to the link 46 leading to the lift cam mechanism 34, and a piston 144 connected to the rack 48 of the rack-and-pinion linkage 36. The pair of opposed fluid chambers of the hydraulic cylinder 140 is to be selectively placed in communication with a source of a hydraulic fluid under pressure and with a fluid drain, both not shown, by a solenoid-operated valve 146. The selective delivery of the pressurized fluid to the fluid chambers makes it possible to infinitely vary the length of connection between lift cam mechanism 34 and rack-and-pinion linkage 36.

Additional modifications and variations of this invention will reaily occur to one skilled in the art within the scope of the invention.

What is claimed is:

1. An apparatus wherein a pair of transfer bars, extending horizontally in parallel spaced relation to each other, are reciprocated longitudinally and moved up and down and toward and away from each other for transporting work through a succession of processing stations, a mechanism for imparting the up-and-down motion to the pair of transfer bars, comprising:

(a) lift carrier means for carrying the transfer bars to as to allow their longitudinal reciprocation and movement toward and away from each other;

(b) a lift cam mechanism;

(c) a rack-and-pinion linkage between the lift cam mechanism and the lift carrier means for moving the latter, and therefore the transfer bars, up and down in response to the operation of the lift cam mechanism;

(d) a cylinder actuated height adjustment mechanism providing a variable length of connection between the lift cam mechanism and the rack-and-pinion linkage for adjustably varying the upper and lower limits between which the transfer bars are moved up and down and wherein the apparatus further includes means for yieldably urging the transfer bars upwardly, and wherein the cylinder actuated height adjustment mechanism includes:

(i) a first link operatively connected at one end to the lift cam mechanism thereby to be reciprocated longitudinally, (ii) an abutment housing rotatably engaged with another end of the first link and constrained to joint reciprocation therewith, the abutment housing generally extending away from the first link in co-linear relation thereto;

(iii) a hollow, multiple abutment member fixedly mounted in the abutment housing and providing a plurality of abutments in various angular positions about the axis of rotation of the abutment housing relative to the first link and at various distances from the first link;

(iv) a second link slidably extending through the multiple abutment member for both relative rotation and lonitudinal displacement and coupled at one end to the rack-and-pinion linkage, the second link being longitudinally biased away from the first link by the yieldably urging means;

(v) hook means on another end of the second link for selective engagement with the abutments of the multiple abutment member depending upon the angular position of the latter relative to the second link; and (vi) drive means acting on the abutment housing to vary the angular position of the multiple abutment member relative to the second link and said hook.

2. The apparatus as recited in claim 1, wherein the multiple abutment member of the height adjustment mechanism is in the form of a hollow cylinder recessed to provide the abutments in diametrically opposed pairs, and wherein the hook means on the second link is adapted to engage any one pair of abutments at one time.

3. The apparatus as recited in claim 1, wherein said drive means of the cylinder actuated height adjustment mechanism comprises:

(a) a driven gear mounted coaxially on the abutment housing for joint rotation therewith;

(b) a drive gear in mesh with the driven gear;

(c) a pinion capable of joint rotation with the drive gear;

(d) a rack in mesh with the pinion; and (e) a fluid actuated cylinder coupled to the rack for longitudinally moving the same.

4. The apparatus as recited in claim 3, further comprising:

(a) a switch actuator on the rack of the drive means; and (b) a plurality of limit switches adapted to be activated by the switch actuator for terminating the travel of the rack in a desired position.

* * * * *